US006649024B2

(12) United States Patent
Oriarian et al.

(10) Patent No.: US 6,649,024 B2
(45) Date of Patent: Nov. 18, 2003

(54) SOFT CHEMI-MECHANICALLY EMBOSSED ABSORBENT PAPER PRODUCT AND METHOD OF MAKING SAME

(75) Inventors: T. Philips Oriarian, Appleton, WI (US); Galyn A. Schulz, Greenville, WI (US); Dale T. Gracyalny, Appleton, WI (US); Michael E. Hennes, Neenah, WI (US); Thomas N. Kershaw, Neenah, WI (US); Anthony O. Awofeso, Appleton, WI (US)

(73) Assignee: Fort James Corporation, Atlanta, GA (US)

( * ) Notice: Subject to any disclaimer, the term of this patent is extended or adjusted under 35 U.S.C. 154(b) by 0 days.

(21) Appl. No.: 10/223,356

(22) Filed: Aug. 20, 2002

(65) Prior Publication Data

US 2003/0041989 A1 Mar. 6, 2003

Related U.S. Application Data

(62) Division of application No. 08/938,520, filed on Sep. 26, 1997, now Pat. No. 6,468,392.

(51) Int. Cl.[7] ..... D21H 21/14; D21H 21/22

(52) U.S. Cl. ..... 162/109; 162/112; 162/113; 162/117; 162/135; 162/136; 162/158; 162/186

(58) Field of Search ..... 162/109, 112, 162/113, 117, 135, 136, 186, 158; 427/421

(56) References Cited

U.S. PATENT DOCUMENTS

| | | | | |
|---|---|---|---|---|
| 171,026 | A | | 12/1875 | LaMonte et al. |
| 366,755 | A | | 7/1887 | Baker |
| 2,803,188 | A | | 8/1957 | Duvall |
| 3,150,416 | A | | 9/1964 | Such et al. |
| 3,554,862 | A | | 1/1971 | Hervy et al. |
| 3,554,863 | A | | 1/1971 | Hervy et al. |
| 3,844,880 | A | | 10/1974 | Meisel, Jr. et al. |
| 3,917,785 | A | | 11/1975 | Kalwaites |
| 4,073,230 | A | | 2/1978 | Akerson |
| 4,135,024 | A | | 1/1979 | Callahan et al. |
| 4,720,383 | A | | 1/1988 | Drach et al. |
| 4,795,530 | A | | 1/1989 | Soerens et al. |
| 5,024,799 | A | | 6/1991 | Harp et al. |
| 5,030,081 | A | | 7/1991 | Schulz |
| 5,091,032 | A | | 2/1992 | Schulz |
| 5,093,068 | A | | 3/1992 | Schulz |
| 5,145,737 | A | | 9/1992 | Boiron et al. |
| 5,223,096 | A | | 6/1993 | Phan et al. |
| 5,225,047 | A | | 7/1993 | Graef et al. |
| 5,246,545 | A | * | 9/1993 | Ampulski et al. ..... 162/112 |
| 5,262,007 | A | | 11/1993 | Phan et al. |
| 5,269,983 | A | | 12/1993 | Schulz |
| 5,312,522 | A | | 5/1994 | Phan et al. |
| 5,316,622 | A | | 5/1994 | Babinsky et al. |
| 5,354,425 | A | | 10/1994 | Mackey et al. |
| 5,399,240 | A | | 3/1995 | Graef et al. |
| 5,399,241 | A | | 3/1995 | Oriaran et al. |
| 5,562,805 | A | * | 10/1996 | Kamps et al. ..... 162/117 |

FOREIGN PATENT DOCUMENTS

| | | | |
|---|---|---|---|
| EP | 707945 | * | 4/1996 |
| EP | 0675 225 | | 2/2000 |

OTHER PUBLICATIONS

"Droplet Measurement Page", Optical Instrumentation Technology Branch, NASA Lewis OITB, www.lerc.nasa.g...ups/Optinstr/drop.html, 2 pages.

Ari Kankkunen et al, "Small Scale Measurement of Black Liquor Spraying with Splashplate Nozzles", 1994 Engineering Conference, TAPPI Proceedings, pp. 207–214.

"Photographic Measurement of Droplet Density", Marshall Space Flight Center, Alabama, NASA Tech Briefs, Summer 1980, pp. 167–168.

Ulrich Vielhaber, "Flussigkeits–Aerosole: Tropfchenanalyse in Abhangigkeit von Zeit und Raum", Aerosol Report, vol. 30, No. 6/91, pp. 313–320.

* cited by examiner

*Primary Examiner*—Peter Chin
(74) *Attorney, Agent, or Firm*—Finnegan, Henderson, Farabow, Garrett & Dunner, LLP

(57) ABSTRACT

The present invention is a method of applying a chemical treating agent to a cellulose web. The invention is further a means of increasing the bulk, absorbency and pattern definition in an embossed cellulose web without losing softness in the web. Finally, the invention includes products produced by the foregoing processes.

23 Claims, 6 Drawing Sheets

PRE-EMBOSS APPLICATION

POST-EMBOSS APPLICATION

SPLIT-PLY POST-EMBOSS APPLICATION

SOFT CHEMI-MECHANICALLY EMBOSSED ABSORBENT PAPER PRODUCT AND METHOD OF MAKING SAME

This is a division of application Ser. No. 08/938,520, filed Sep. 26, 1997, now U.S. Pat. No. 6,468,392.

FIELD OF THE INVENTION

The present invention relates to a visually pleasing, soft, and absorbent paper product having improved bulk, absorbency and embossing pattern definition and a method for the manufacture of such a paper product. The present invention also relates to a method of efficiently delivering a treating agent to a web.

BACKGROUND OF THE INVENTION

In the area of consumer paper products, for example, bathroom tissue, paper towels and napkins, softness, absorbency, and strength are key attributes considered by consumers. It is highly desirable that the paper product have a consumer perceived feel of softness. This softness plays a key role in consumer preference. Softness relates both to the product bulk and surface characteristics. In addition to softness, the consumer desires a product that is both strong and absorbent to minimize the amount of the product which must be used to do an effective job.

Visual impression is known to dominate the other human senses. A consumer faced with a visually pleasing product establishes an expectation for that product, and unless that expectation is baseless, the product rarely fails to live up to the consumers expectation. In other words, a consumer who visually perceives a product to be soft and absorbent almost always finds the product to actually have those characteristics. Embossing designs can impart both nonvisual qualities in terms of bulk and absorbency, as well as visual qualities based upon perception because vision plays such a dominant role in consumer perception.

To improve softness, standard paper making processes often add chemicals, e.g., softeners and debonders, to a fiber furnish or web to improve or change the properties of the web. Traditionally, softeners and debonders are used in the papermaking process to enhance softness or to adjust strength. Typically, these chemicals are added to the wet end of the paper making process, i.e., in the paper making slurry. When used in this manner, these chemicals react with fines, pitch, sand and other materials associated with pulp fibers to form deposits. Deposits negatively impact productivity because they bind fabrics, plug felts and significant expenses must be incurred to remove the deposits. In some instances, the presence of these chemicals requires adjustment of the system pH. Because of the fatty acid groups, hydrophobicity is imparted on the paper product and this renders it non-absorbent. In some cases, additional expense must be incurred when hydrophilic surfactants are used to restore or impart absorbency.

In most cases, the tensile strength is significantly reduced. Either additional energy is used in refining or additional expense is incurred when a dry strength additive is needed for strength adjustment. Either way, the softness gained in this way is compromised because of the inverse relationship between softness and strength. When used in this manner, softeners and debonders, while enhancing softness and bulk, will have no effect on emboss pattern definition.

Alternatively, these chemicals have occasionally been sprayed onto the wet web prior to drying. These processes suffer from the disadvantages of contamination and materials loss since the chemicals are often lost with the moisture removed from the web during the drying process. Chemicals applied in this manner are usually recirculated back to the wet end where they also react with fines, pitch, sand, and other materials associated with the pulp fibers to form deposits and may require pH adjustment. Deposits negatively impact performance and are expensive to remove and clean up. In most cases, tensile strength is significantly reduced.

The interplay of softness and strength have been the focus of much research. U.S. Pat. No. 4,759,530 teaches the creation of soft surface zone/strong zone composites whereby debonder penetration is limited to 40% of the sheet with the use of vacuum suction installed in front of the applicator to control debonder penetration.

Embossing is the act of mechanically working a substrate to cause the substrate to conform under pressure to the depths and contours of a patterned embossing roll. During an embossing process, the roll pattern is imprinted to the web at a certain pressure or penetration depth. Embossing usually results in a paper web having increased caliper or bulk and absorbency; however, this increase is usually accompanied by an increase in the surface roughness or friction deviation and strength decrease of the embossed tissue or towel product. For a given pattern, the amount of caliper generated and how well the pattern is defined on the substrate depends on the pressure applied on the emboss rolls. Embossing reduces the strength of the tissue as the emboss pressure applied to the patterned rolls is increased. By enhancing pattern definition at a fixed penetration depth, the present invention overcomes the aforementioned deficiencies.

In the production of paper products it is known to emboss sheets comprising multiple plies of creped tissue to increase the surface area of the sheets thereby enhancing their bulk and moisture holding capacity. Highly defined emboss patterns are desirable for their aesthetic appearance.

Chemicals have not traditionally been added to a web after drying because the drying process is designed to impart certain characteristics of, for example, stretch and crepe to a cellulose web. When a dried web is rewet, the additional water/moisture increases hydrogen bonding in the web resulting in a web having increased tensile strength; however, the stiffness or rigidity of the web is also increased. In creped structures, the web loses a majority of its stretch, its crepe and also becomes less soft and coarse. Typically, operational problems are also encountered when the web is rewet as it becomes difficult to subject the web to any tension needed to make rolls or to form the web into reels. In addition to the disadvantages outlined above, a rewet web will have to be subjected to an additional drying process.

As can be seen from U.S. Pat. Nos. 2,803,188; 4,073,230 and 4,135,024, the use of water to rewet the sheet and enhance the definition of the embossing pattern is known. Each of these systems use high temperature to set the pattern because of the need to dry the sheet. Since none of these systems controls the droplet size, it is evident that each system causes sheet rewet requiring subsequent drying. As discussed above, this rewet causes significant losses in web characteristics, for example, stretch and crepe, as well as resulting in a sheet that is stiff, coarse and less soft. As used herein stretch is related to crepe. Pulp and Paper: Chemistry and Chemical Technology, 3rd Edition, Vol. 3, Edited by J. P. Casey defines stretch and/or elongation as the amount of distortion that paper undergoes under tensile stress and it is usually measured on the tensile tester at the same time tensile strength is measured.

Emboss definition refers to the contrast between adjacent surfaces created as a result of shadowing. Shadowing is created by relative elevations between the surfaces of a paper web and the abruptness of the change in elevation or topography between the surfaces. Generally, as a web is passed through an emboss nip, some areas of the web in the pattern experience higher levels of densification. Increased densification and opacity created at the top of a protuberance tends to improve the definition of the embossing pattern by enabling the structure to hold its shape. The relative reflectivity and opacity of the surfaces of the web also contribute to the intensity of the shadowing effect which results in improved emboss definition.

While the use of embossing and the use of softening/debonding agents have individually been known for some time, these processes have never been combined as described herein to simultaneously enhance pattern definition, bulk and absorbency in a paper product.

In addition, the present invention overcomes disadvantages in the prior art associated with building strength, bulk, absorbency and softness into a web. Usually, bulk and absorbency can be added to a web but at the expense of softness, particularly surface roughness as measured by friction deviation. With the method according to the present invention, all three, bulk, absorbency and softness in addition to pattern definition can be improved simultaneously without loss or relaxation of stretch and crepe.

The present invention overcomes these and other disadvantages associated with the prior art. The present invention provides both a method for applying a chemical treatment to a dried web and a method for improving the definition of an emboss pattern without the disadvantages of the prior art liquid applications including the need for an added drying step.

SUMMARY OF THE INVENTION

The present invention provides a method whereby treating agents may be added to a dried web with the advantages of high solids delivery, precision in material delivery, improvement in web qualities, and high productivity. The present invention provides a method whereby a treating agent can be added to a dried web without web rewet or loss of crepe, stretch or process runnability.

The present invention also provides an improved method of setting an emboss pattern with softening and debonding treatment agents and/or water while maintaining stretch and crepe and improving pattern definition, bulk, and absorbency of the embossed product. Specifically, the present invention provides a method of delivering a treating agent to a cellulose web, preferably having an average pore size distribution of from about 100 to about 1000 $\mu$m and a preferred solids content of from about 70% to about 100%, in an average droplet size of no greater than 200 $\mu$m. No heat treatment or additional drying of the web is necessary; no adjustment of the pH is necessary; and no adjustment of the penetration depth of emboss roll pressure is necessary.

The present invention also provides a chemi-mechanically softened, absorbent embossed paper product having enhanced softness, pattern definition, bulk and absorbency. The present invention also provides softening and debonding compositions and an emboss process as described to set emboss patterns so that the products with enhanced visual or pattern definition, softness, bulk and absorbency are obtained. All of these attributes being achieved without loss in crepe, stretch, process runnability or the need to increase the penetration depth or pressure in the emboss process.

To achieve the foregoing advantages and in accordance with the purpose of the invention, as embodied and broadly described herein, there is disclosed:

A method of efficiently delivering a treating agent to a cellulose web including providing a cellulose web having a solids content of at least about 70% and treating the web with a treating agent having an average droplet size not greater than 200 $\mu$m.

There is further disclosed:

A method of enhancing emboss definition in a cellulose web without loss of softness including applying to the cellulose web a liquid agent having an average droplet size not greater than 200 $\mu$m; embossing the cellulose web; and again applying a liquid agent which may be the same or different and also having an average droplet size not greater than 200 $\mu$m.

Further advantages of the invention will be set forth in part in the description which follows and in part will be apparent from the description, or may be learned by practice of the invention. The advantages of the invention may be realized and attained by means of the instrumentalities and combinations particularly pointed out in the appended claims.

The accompanying drawings, which are incorporated in and constitute a part of the specification, illustrate various aspects of the invention and, together with the description, serve to explain the principles of the invention.

DETAILED DESCRIPTION

Figure 1:
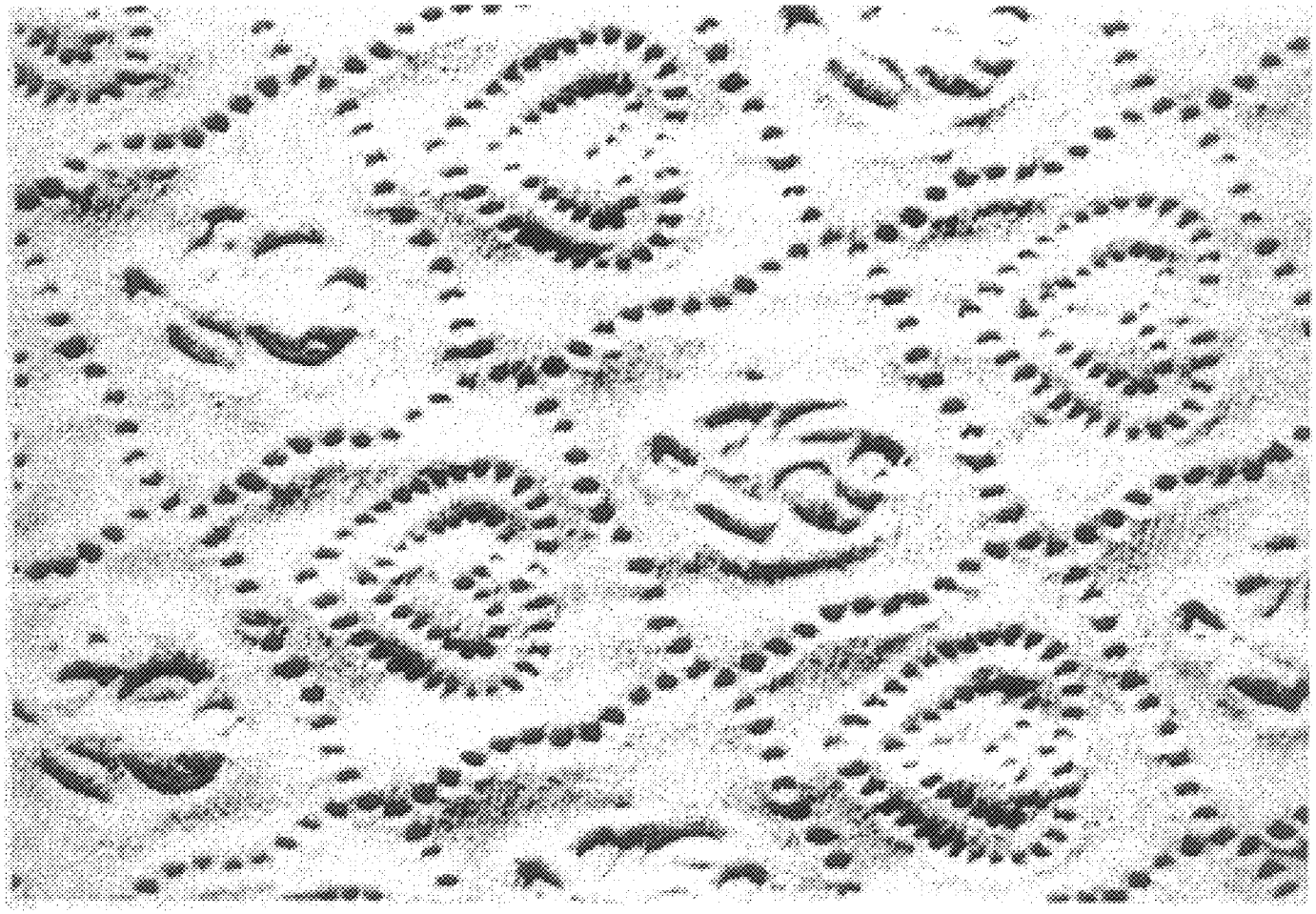
FIG. 1 is a photograph of a chemi-mechanically embossed absorbent paper product wherein the chemical treatment was conducted prior to the web entering the embossing nip.
Figure 2:
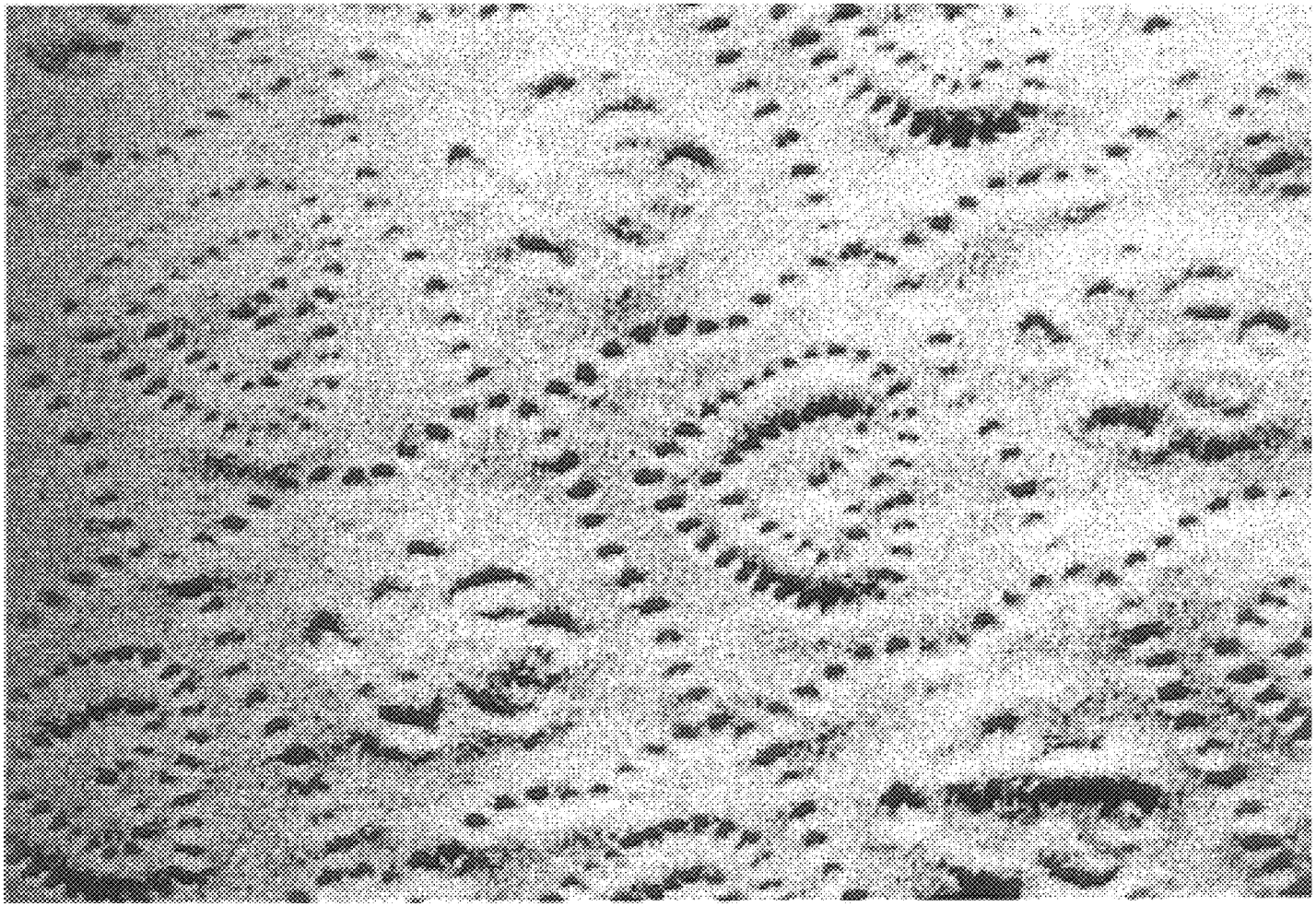
FIG. 2 is a photograph of a chemi-mechanically embossed absorbent paper tissue product wherein the chemical treatment was conducted after the embossing nip.
Figure 3:
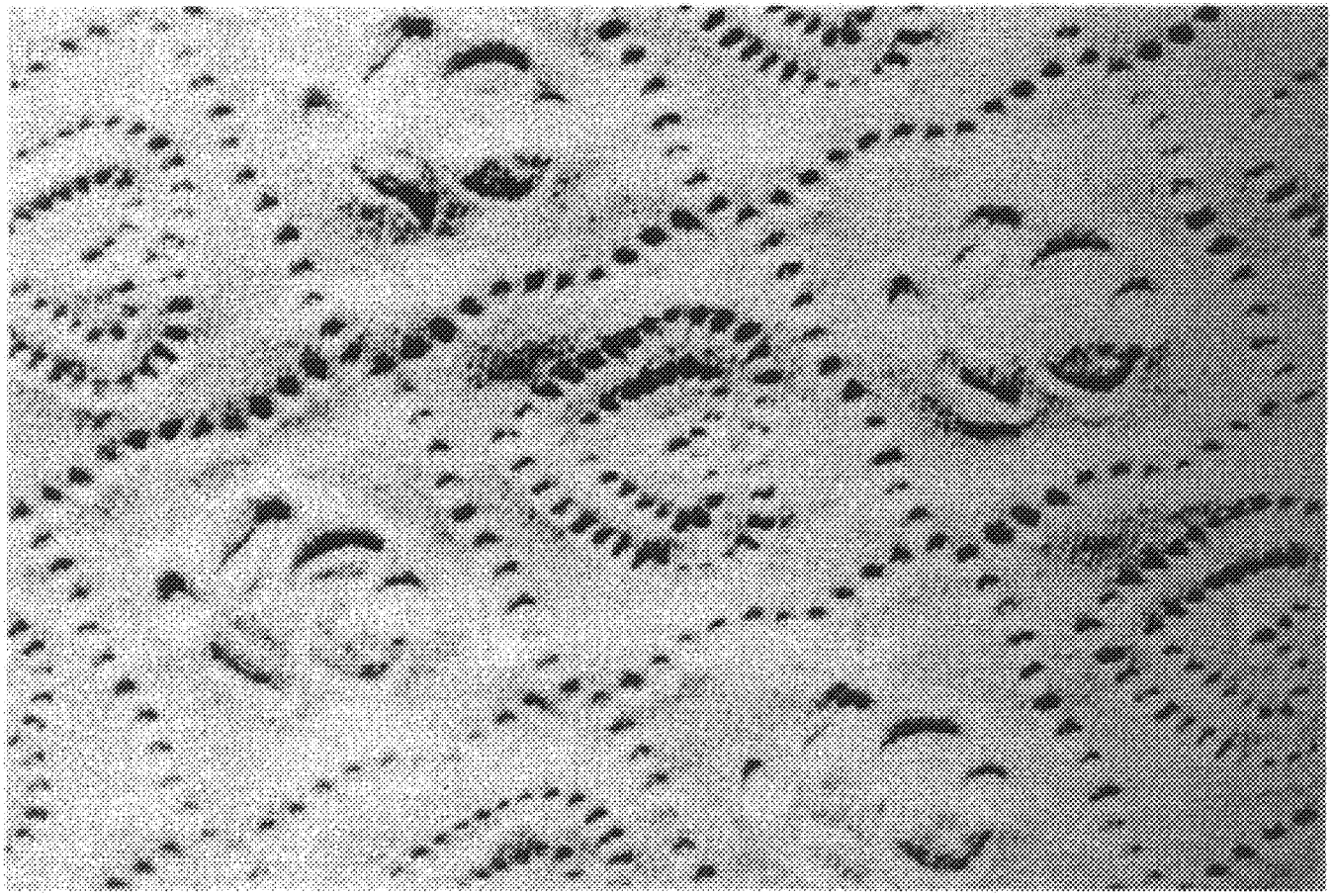
FIG. 3 is a photograph of an embossed tissue that was neither pre- or post-treated with a softener/debonder.

The present invention is directed to a method of chemically treating a web while enhancing bulk, softness, and absorbency. Specifically, the present invention allows the application of liquid materials to a dried web without rewetting the web, thus, preventing the need for subsequent drying steps. The present invention also allows chemi-mechanical embossing of a dried web through the application of a softener or debonder to a dried web while setting emboss pattern definition, thus resulting in an aesthetically pleasing embossed product.

The present invention in addition to the advantages discussed above, prevents negative chemical interactions in the paper making system. If, for example, the application of the treating agent is in the converting line, the present invention also prevents microcontamination of the papermaking broke.

The present invention can be used with webs selected from natural or synthetic fibrous materials. Webs for use according to the present invention preferably have a pore size of from about 100 μm to about 1000 μm, more preferably about 300 μm to about 900 μm, and still more preferably about 500 μm to about 800 μm. Webs are preferably at a solids content of at least about 70%, more preferably at least about 85%, still more preferably at least about 90% and most preferably at least about 95%.

Still more preferably, the present invention is directed to the treatment of cellulose based webs. In one aspect, the present invention is concerned with webs used to make consumer paper products. As used herein, the term paper refers to cellulose based web or sheet made by a process generally including one or more of the following steps:

a) forming a papermaking furnish (aqueous, dry forming (air laid) or foam forming);

b) depositing the furnish on a foraminous surface, e.g., a forming fabric;

c) removing water using either conventional wet processes or through-air-drying;

d) drying the web on a Yankee dryer; and e) optionally creping the web off the Yankee dryer.

Upon removal of the web from the papermaking apparatus, the web according to the present invention is preferably dried to a moisture content of not greater than about 25%, more preferably a moisture content of from about 5 to about 10%.

The method according to the present invention can be applied at any point in the dry end of the paper making process. The dry end is defined as points after achieving target moisture content and may include points from the crepe blade through the calender to the reel. The dry end also includes the converting line.

In one preferred embodiment, the treating agent may be applied prior to the web being rolled, for example, prior to calendering or at the point of calendering to improve, for example, the luster or friction of the web. According to still another embodiment of the invention, the treating agent is applied to the web at a point just prior to or just after passage of the web through an embossing nip. In another embodiment of the invention, the treating agent is applied before and after the web passes through the embossing nip.

When the present invention is used with an embossing nip, the invention can be used with any art recognized emboss configuration. Appropriate emboss configurations include dual or multi-roll and single or multi-nip embossing systems. The embossing configurations are preferably rigid-to-resilient or rigid-to-rigid systems.

In a rigid-to-resilient embossing system, the single or multi-ply substrate is passed through the nip formed between a roll whose substantially rigid surface contains a multiplicity of protuberances and/or depressions arranged into an aesthetically-pleasing pattern and a second, roll, whose substantially resilient surface can be either smooth or also contain a multiplicity of protuberances and/or depressions which cooperate with the rigid surfaced patterned roll. The rigid roll can be formed with a steel body and directly engraved upon or can contain a hard rubber-covered surface (directly coated or sleeved) upon which the embossing pattern is laser engraved. The resilient roll may consist of a steel core directly covered or sleeved with a resilient material such as rubber and either ground smooth or laser-engraved with either a mated or a non-mated pattern corresponding to the rigid roll.

In the rigid-to-rigid embossing process, the single or multi-ply substrate is passed through the nip formed between two substantially rigid rolls. The surfaces of the rolls contain a multiplicity of protuberances and/or depressions arranged into an aesthetically-pleasing pattern where the protuberances and/or depressions in the second roll cooperate with the first rigid patterned roll. The first rigid roll can be formed with a steel body and directly engraved upon or can contain a hard rubber-covered surface (directly coated or sleeved) upon which the embossing pattern is laser-engraved. The second rigid roll can be formed with a steel body or can contain a hard rubber covered surface (directly coated or sleeved) upon which a matching or mated pattern is conventionally engraved or laser-engraved.

Variation or combination of the rigid-to-resilient and/or rigid-to-rigid embossing processes are well understood by the skilled artisan and could be appropriately used in conjunction with the present invention. For example, nested embossing, point-to-point embossing, and multi-nip embossing processes are also within those configurations appropriate for use with the present invention. See for example, U.S. Pat. Nos. 5,093,068, 5,091,032, 5,269,983 and 5,030,081 to Galyn A. Schulz.

The web may be embossed with any art recognized embossing pattern, including, but not limited to, overall emboss patterns, spot emboss patterns, micro emboss patterns, which are patterns made of regularly shaped (usually elongate) elements or combinations of overall, spot, and micro emboss patterns.

In one embodiments of the present invention, the emboss pattern of the one-ply product may include a first set of bosses which resemble stitches, hereinafter referred as stitch-shaped bosses, and at least one second set of bosses which are referred to as signature bosses. Signature bosses may be made up of any emboss design and may be related by consumer perception to the particular manufacturer of the tissue.

In another aspect of the present invention, a paper product is embossed with a wavy lattice structure which forms polygonal cells. The cells need not be completely closed structures to achieve the preferred effects of this pattern. These polygonal cells may be diamonds, hexagons, octagons, or other readily recognizable shapes. In one preferred embodiment of the present invention, each cell is filled with a signature boss pattern. More preferably, the cells are alternatively filled with at least two different signature emboss patterns.

In another preferred embodiment, one of the signature emboss patterns is made up of concentrically arranged elements. These elements can include like elements, for example, a large circle around a smaller circle, or differing elements, for example, a larger circle around a smaller heart. In a most preferred embodiment of the present invention, at least one of the signature emboss patterns are concentrically arranged hearts. The use of concentrically arranged emboss elements in one of the signature emboss patterns adds to the puffiness effects realized in the appearance of the paper product tissue. The puffiness associated with this arrangement is the result not only of appearance but also of an actual raising of the tissue upward. In another preferred embodiment, another signature emboss element is a flower.

In one embodiment of the present invention, emboss elements are formed having the uppermost portions thereof formed into crenels and merlons, hereinafter referred to as "crenulated emboss elements." By analogy, the side of such an emboss element would resemble the top of a castle wall having spaced projections which are merlons and depressions therebetween which are crenels. In a preferred embodiment, at least one of the signature emboss patterns is formed of crenulated emboss elements. More preferably, the signature boss pattern is two concentrically arranged hearts, one or both of which is crenulated.

In another preferred embodiment of the present invention, the signature bosses have a height of between 10 thousandths and 90 thousandths of an inch. The crenels are preferably at a depth of at least 3 thousandths of an inch. It is understood that the use of merlons which are unequally spaced or which differ in height are embraced within the present invention.

According to the present invention, when the web or sheets are formed into a roll, the tissue is aligned so that the bosses are internal to the roll and the debossed side of the tissue is exposed. In the present invention, the boss pattern is offset from the machine direction, the machine direction being parallel to the free edge of the web in the cross direction, by more than 10° to less than 170°.

In one embodiment of the present invention, the boss pattern combines stitch-shaped bosses with a first signature boss made up of linear continuous embossments and a second signature boss pattern made up of crenulated embossments. The overall arrangement of the pattern is selected so that when the sheets are formed into a roll, the signature bosses fully overlap at a maximum of three locations in the roll, more preferably at least two location, the outermost of these being at least a predetermined distance, e.g., about an eighth of an inch, inward from the exterior surface of the roll. Moreover, the overall average boss density is substantially uniform in the machine direction of each strip in the roll. The combined effect of this arrangement is that the rolls possess very good roll structure and very high bulk.

The signature bosses are substantially centrally disposed in the cells formed by the intersecting flowing lines and serve to greatly enhance the bulk of the tissue while also enhancing the distortion of the surface thereof. At least some of the signature bosses are continuous, rather than stitch-shaped and can preferably be elongate. Other of the signature bosses are crenulate and, preferably, are also substantially centrally disposed in cells formed by intersecting flowing lines. The signature bosses enhance the puffy or filled appearance of the sheet both by creating the illusion of shading, as well as, by resulting in actual shading due to displacement of the sheet apparently caused by puckering of surrounding regions due to the embossing or debossing of the signature bosses.

A most preferred emboss pattern is made up of a wavy lattice of dot shaped bosses having hearts and flowers within the cells of the lattice. It is also preferred that the emboss pattern of the present invention be formed, at least in part, of crenulated emboss elements. As previously discussed, a crenulated emboss element is one that has a side base with smaller separated land areas at the apex, resembling, for example, the top of a castle wall. Such an emboss pattern further enhances the tissue bulk and softness. The emboss elements are preferably less than 100 thousandths of an inch in height, more preferably less than 80 thousandths of an inch, and most preferably 30 to 70 thousandths of an inch.

In preferred embodiments of the present invention, the basis weight of any single ply of tissue product is preferably from about 10 to about 35 lbs/ream, more preferably from about 17 to about 20 lbs/ream. The basis weight of any single ply of a towel product is preferably from about 10 to about 50 lbs/ream, more preferably from about 15 to about 30 lbs/ream.

The caliper of the product of the present invention may be measured using the Model II Electronic Thickness Tester available from the Thwing-Albert Instrument Company of Philadelphia, Pa. For tissue, the caliper is measured on a sample consisting of a stack of eight sheets of tissue using a two-inch diameter anvil at a 539±10 gram dead weight load. Single-ply tissue according to the invention has a preferred caliper after calendering and embossing of from about 20 to about 200 mils per 8 plies, more preferably a caliper of from about 40 to about 100 mils per 8 plies In each embodiment of the invention, one or more treating agents can be applied to the web. This may be accomplished through one or more applicator systems. Application of multiple treating agents using multiple application systems helps to prevent chemical interaction of treating materials prior to their application to the cellulose web. Application of the treating agent according to the present invention can be to either one or both surfaces of the web. Alternative configurations and application positions will be apparent to the skilled artisan.

The treating agents for use in the present invention may be solid or liquid. The preferred treating agents which may be applied to the web include softeners and debonders. Any class of softening/debonding agents will be satisfactory and all have excellent retention, on the order of 60 to 80% in the treated and embossed products. Softening and debonding agents of the present invention which may be applied to the web include cationic, anionic and nonionic softeners and debonders, humectants lotions, botanical extracts, perfumes, mineral oils, refined oils, disinfectants, water, surfactants, silicones and the like. Additional materials which may be applied to a web using the method of the present invention will be apparent to the skilled artisan.

Suitable softeners/debonding agents will be readily apparent to the skilled artisan and are widely described in the patent literature. A comprehensive but non-exhaustive list includes U.S. Pat. Nos. 4,795,530; 5,225,047; 5,399,241; 3,844,880; 3,554,863; 3,554,862; 4,795,530; 4,720,383; 5,223,0965,262,007; 5,312,522; 5,354,425; 5,145,737, and EPA 0 675 225 each of which is specifically incorporated herein by reference in its entirety.

Preferred softeners and debonding agents include glycols, specifically propylene glycol; diamidoamine quaternary ammonium compounds, specifically methyl bis tallow amido ethyl 2-hydroxy ethyl ammonium methyl sulfate; quarternary imidoazoline compounds, specifically methyl-1-tallow amido ethyl-2-tallow imidazolinium methyl sulfate; and alkyoxylated quaternary ammonium compounds; linear amine amides; glycols; silicones; lecithin based amphoteric softeners; carboxylic acid esters; and mixtures of the foregoing. More particularly, the softener may be Quasoft 202 JR®, 218®, 209® and 219®, and Varisoft 475® from Quaker Chemical and WITCO Corporation, respectively.

Preferred cationic debonder compositions for use as a treating agent in the present invention include fatty alkyl di or trimethyl ammonium type compounds of the formula

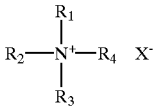

quaternary imidoazoline type debonders of the formula

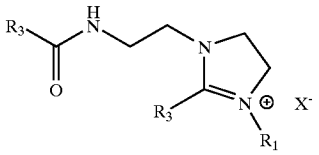

diamidoamine quarternary ammonium debonders of the formula

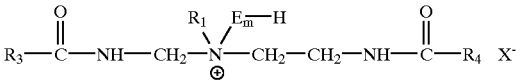

dialky alkoxylated ammonium type debonders of the formula

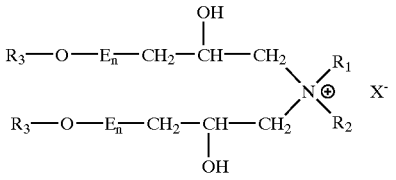

amino acid salts; linear amine amides; mixtures of the foregoing classes. In each of the foregoing formulas $R_1$ and $R_2$ are methyl, ethyl, or hydroxy ethyl; $R_3$ and $R_4$ are hydrocarbons having 7 to 40 carbon atoms; E is an ethoxy or propoxy group; m is an interger from 1 to 20; n is an interger from 0 to 20; $X^-$is $Cl^-$, $HSO_4^-$, $CH_3SO_4^-$, or $CH_3CH_2SO_4^-$. Variations of biodegradable mono- and diester forms of the quaternary ammonium compounds are also suitable.

Preferred anionic softening and debonding compositions for use as a treating agent in the present invention include sulfated fats; fatty esters; fatty alcohols; fatty alkyl substituted aromatic sulfonic acids where the fatty substituent groups may have 8–40 carbon atoms, more preferably 10–22 carbon atom; carboxylated surfactants, such as AOS (alpho olefin sulfonates), Turanol, and the like.

Preferred nonionic softening and debonding compositions for use as a treating agent in the present invention are adduct type reaction product of, for example, fatty aliphatic alcohols; fatty alkyl phenols; fatty aromatic and aliphatic acids with ethylene oxide, propylene oxide, or mixtures of the two, preferably the fatty portion is a hydrocarbon chain with 10–22 carbon atoms; partial fatty acid esters of polyvalent alcohols and anhydrides with 2 to 8 carbon atoms.

Other nonionic debonding agents include alkyl polygycosides; lanolin and lanolin derivatives; alkanolamides; amine oxides; propoxylates; ethoxylates; sorbitan esters; sorbitan ethoxylates; ethoxylated modified triglycerides.

Softening and debonding agents are preferably added in an amount of not greater than about 20% by weight, more preferably not greater than about 10% and most preferably between about 2% and about 4%.

Other treating agents include humectants which are hygroscopic materials with a two fold moisturizing action (water retention and water absorption). Preferred classes of humectants for use in the present invention include hydroxy or polyhydroxy materials selected from glycols and diols; amides and acetamides. Preferred humectants include ethylene glycol; diethylene glycol, triethylene glycol; tetraethylene glycol, propylene glycol, dipropylene glycol, tripropylene glycol, acetamide MEA, acetamidopropyl trimonium chloride produced by Croda chemical.

Further, the treating agent may be a silicone. Preferred silicone compounds for use in the present invention include nonreactive dimethylpolysiloxanes of the formula

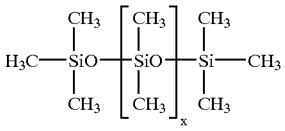

X is 1 to 100;

conventional reactive polysiloxanes of the formula

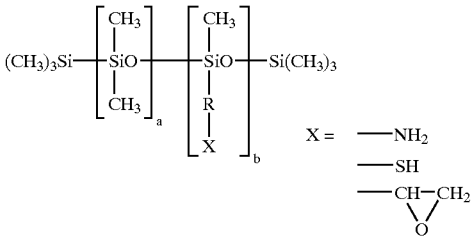

wherein

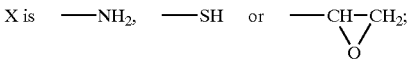

a=1 to 30.

b/(a+b)=0 to 0.2 and organoreactive silicones with amino, mercapto and epoxy functionalities.

Other treating agents include lotion, typically a mixture of mineral oils, fatty alcohols, surfactants and esters; and nonionic surfactants, including alkyl polyglycosides (APG) s. APGs generally consist of hydrophyllic sugar groups, e.g., glucose and a hydrophobic fatty alcohol group. Examples of APGs useful in the present invention include GLUCOPON 425CS available from Henkel Chemical Corp. and ORAMIX available from SEPPIC.

An important aspect of this invention is the particle size or particle size distribution at which softening and debonding agents and other treatment chemicals are delivered to the paper being treated. While not wishing to be bound by theory, it is believed that for effective deposition and performance on a given substrate, the droplet size of the applied material plays an important role. This is thought to be because the droplet size of the applied material affects the settling velocity and drift on the surface of the substrate to which it is applied. The settling velocity varies approximately as the square of a droplet's diameter. For example, a 400 micrometer droplet size would fall 4 times as fast as a 200 micrometer droplet and would drift ¼ as far when transported at equivalent wind speeds. Depending on the substrate and distance from the applicator, if the droplet size is too large for example, substrate surface disruption occurs from the droplet impact. For the paper used in this invention, it has been found that the most favorable results are obtained when the droplet size of the treatment chemical is controlled below 200 microns. Additional information on droplet size and impact on substrate surface can be found in David J. Hillis and Yuping Gu "Sprinkler Volume Mean Droplet Diameter as Fuction of Pressure". Transactions of the ASAE, Vol. 32, No.2, March-April 1989; and J. Li, H. Kawano and K. Yu "Droplet Size Distributions From Different Shaped Sprinkler Nozzles". Transactions of the ASAE, Vol. 37, No.6, November/December 1994.

The surface of the paper used in this invention has pores with mean pore openings or a pore diameter of from about 100 to about 1000 micrometers. The size of pores in a given paper can be measured by placing the paper sample in a Zeiss STEMI-SV8 stereo microscope and imaging the sample at a magnification of 64× using brightfield transmitted light. Images are then collected using a Dage-MTI model 72 CCD camera. Camera Control Unit (CCU) settings used to measure paper samples of this invention are: gain=4.7; blacklevel=9.2; gamma=1.0; polarity=positive; stretch=off. For the present invention, images are preferably collected and digitized to 512×480×256 resolution by a Tractor Northern TN-8502 image analyzer. No shade correction need be applied and frame grabber settings are preferably: gain=1; offset=128. For image processing and analysis, binary images can be produced from the grey level images by global segmentation of image histograms using a threshold range from 112 to 255 grey units. A stereological guard region of 50 μm can be applied during pore sizing to eliminate biasing in favor of smaller pores.

Application of the treating agent of the present invention is preferably carried out at an average droplet size of not greater than 200 μm. More preferably, the treating agent is applied in an average droplet size of not more than 100 μm, still more preferably in an average droplet size of from about 20 to about 70 μm. In one preferred embodiment, the treating agent is applied in an average droplet size of not greater than about 50 μm. In still another embodiment, the treating agent is applied in an average droplet size of not greater than about 25 μm. The application of the treating agent in this manner prevents rewet of the fibrous web and thus prevents the need for the application of heat or any additional drying of the web.

The treating agent may be applied by any delivery apparatus which can maintain the required average droplet size or where droplet size can be controlled. Appropriate applicators include, but are not limited to, hydraulic nozzles, atomized nozzles and electrostatic applicators.

In a preferred embodiment of the present invention, the treating agent is applied by a rotorary dampening system. Such a rotorary dampening system is available from WEKO. In this system, a treating agent is applied by means of special spraying discs called rotors that are aligned and are designed to spin. In the process of spinning, these discs throw the treating agent onto the passing web. Each rotor has a certain spray area and the rotors are aligned side by side in a rotor carrier. The spraying width of the individual rotors is fixed by a diaphragm on the rotor carrier so that the fans of the spray are contiguous, ensuring a uniform application over the entire width of the material. The treating agent can be applied uniformly or in a pattern on the web; however, the treating agent is preferably applied uniformly across the web.

In one embodiment of the invention, the treating agent is specifically applied prior to entry of the web into the embossing nip. Application of the treating agent at this point helps to improve bulk, absorbency and the definition of the emboss pattern. Further, if the treating agent is not water, the sheet properties such as strength and softness may also be simultaneously modified resulting in an overall improvement in product attributes.

EXAMPLES

Examples 1–13

A cellulosic web having a basis weight of 17 lbs/ream was prepared using conventional wet press technology. The web showed a Gassian pore size distribution of about 100 to 1000 μm. When the sheet was at a moisture content between 5–10%, a rotor dampening system applied a treating agent to the web during conversion. The web was embossed with a double heart pattern, see FIG. 4, using a steel emboss roll and a rubber backing roll. The emboss penetration depth was 0.100 inches and the machine speed was maintained at 200 feet per minute. The treating agent, i.e., debonder, softener, lotion or silicone was applied, before the emboss nip and at an average droplet size of not greater than 200 μm. The treating agent was added in an amount of from about 4% based upon the dry weight of the base sheet.

The sheet properties achieved are set forth in Table 1, below.

TABLE 1

| Ex. | Chemistry | Percent Chemical Retained | Bulk | Caliper (mils/8) | Friction (GMMMD) | GMT (g/3 in) | Modulus (g/% strain) | Sensory Softness |
|---|---|---|---|---|---|---|---|---|
| 1 | None | — | 3.7 | 64 | 0.222 | 798 | 18 | 15.09 |
| 2 | Water | — | 4.2 | 70 | 0.232 | 892 | 22 | 15.00 |
| 3 | Quasoft 223 | 72 | 4.0 | 69 | 0.218 | 731 | 20 | 15.22 |
| 4 | ABIL GR 88 | 68 | 4.0 | 68 | 0.233 | 631 | 18 | 15.52 |
| 5 | Varisoft 475 | 78 | 4.0 | 68 | 0.206 | 647 | 17 | 15.67 |
| 6 | Lotion | 80 | 3.9 | 66.5 | 0.212 | 554 | 18 | 15.73 |
| 7 | Lotion | 77 | 3.7 | 66 | 0.202 | 550 | 17 | 15.79 |
| 8 | Quasoft 202 | 65 | 4.0 | 71 | 0.212 | 747 | 20 | 15.39 |
| 9 | Quasoft 202 (Lotion) | 68 | 3.9 | 67 | 0.199 | 619 | 17 | 15.72 |
| 10 | Propylene Glycol | 65 | 4.0 | 70 | .16 | 745 | 17 | 15.35 |
| 11 | Quasoft 206 | 82 | 4.0 | 68 | .206 | 658 | 17 | 15.60 |
| 12 | Glucopan 425 CS | 67 | 3.9 | 66 | .218 | 839 | 18 | 15.34 |
| 13 | Varisoft 222 | 71 | 4.1 | 70 | 0.211 | 684 | 17 | 15.48 |

The treatment chemicals:

| Treatment Chemical | Vendor | Type |
|---|---|---|
| Control | — | No Chemical Treatment |
| Water | — | — |

-continued

| Treatment Chemical | Vendor | Type |
|---|---|---|
| Propylene Glycol | Dow Chemical, Freeport, Texas | Humectant (hydroxy material-glycol) |
| Varisoft 222 | Witco, Greenwich, CT. | Cationic, methyl bis tallow amido ethyl; 2-hydroxyethyl ammonium methyl sulfate |
| Varisoft 475 | Witco, Greenwich, CT. | Cationic, quaternary imidazoline, methyl-1-tallow amido ethyl-2-tallow imidazlinium methyl sulfate |
| Quasoft 206 | Quaker Chemical Corp., Conshohoken, PA. | Cationic, dialkyl dimethyl alkoxylated quaternary ammonium compound |
| Quasoft 223 | Quaker Chemical Corp., Conshohoken, PA. | Amphoteric, mixtures of lecithin, PEG 200 Monooleate, PEG 200 Dilaureate, Castor oil, and ethoxylated lanolin |
| ABIL GRH 88D2 | Goldsmidt | Cationic silicone blend of organon modified polysiloxane comprising of dimethicone copolyol, propylene glycol and Quaternum 80 |
| Lotion | Glen Corp., St. Paul, MN. | Mixtures of mineral oil, fatty alcohol, pair of surfactants, and esters |
| Glucopon 425 CS | Henkel Corp. | Nonionic alkyl polyglycoside (APG) |
| Quasoft 202 JR | Quaker Chemical Corp., Conshohoken, PA. | Cationic blend of linear amidoamides and imidazolines. Variants are Quasoft 209 and 219 (with derivitized lanolin). |

The above examples establish that the caliper, surface friction and/or sensory softness were improved for tissue of the present invention. For each sample there was a concurrent improvement in pattern definition. All the benefits were achieved at the same time and without the need to adjust penetration depth.

Porofil Absorbency/Bulk Density Results

| Treatment Chemical | Porofil Results |
|---|---|
| Control (No Chemical Treatment) | 651 |
| Water | 647 |
| Quasoft 223 | 601 |
| ABIL GR 88 | 645 |
| Varisoft 475 | 662 |
| Lotion | 686 |
| Lotion | 672 |
| Quasoft 202 JR | 640 |
| Quasoft 202 JR/Lotion | 654 |

By chemi-mechanically embossing the dry web, data show that there is no degradation in absorbency/bulk density as measured by the volume of Porofil that the chemi-mechanically embossed products could hold. In practicing chemical treatment according to prior art, hydrophobicity is imparted on the surface by the fatty acid groups, thereby decreasing absorbency.

Examples 14–26

These examples we carried out with a paper web as set forth in examples 1–13 above. These examples demonstrate the effectiveness of the softeners and the method of application, when used in conjunction with the emboss process on stretch retention in embossed and unembossed finished products. Notice stretch retention in control and treated tissues. The amount of stretch retained can also be observed by comparing the serpentine nature of the micrographs displayed in FIGS. 7–9.

| Treatment Chemical | % MD Stretch Pre-Emboss Application | % MD Stretch Pre & Post Emboss Application | % MD Stretch Post Emboss Application |
|---|---|---|---|
| Control | 21 | 21 | 21 |
| Water | 19 | 20 | 20 |
| Propylene Glycol | 21 | 20 | 20 |
| Varisoft 222 | 19 | 20 | 19 |
| Varisoft 475 | 18 | 20 | 19 |
| Quasoft 206 | 20 | 19 | 19 |
| Quasoft 223 | 20 | 18 | 19 |
| ABIL GR 88 | 18 | 21 | 19 |
| Lotion | 19 | 20 | 19 |
| Lotion | 19 | 19 | 20 |
| Glucopon 425 CS | 20 | 19 | 20 |

-continued

| Treatment Chemical | % MD Stretch Pre-Emboss Application | % MD Stretch Pre & Post Emboss Application | % MD Stretch Post Emboss Application |
|---|---|---|---|
| Quasoft 202 JR | 20 | 20 | 19 |
| Quasoft 202 JR/Lotion | 19 | 20 | 17 |

Examples 27–30

A paper web was prepared using conventional wet press technology. A rotor dampening system applied a treating agent to the web during conversion. The web was embossed with a double heart pattern, see FIG. 4, using a steel emboss roll and a rubber backing roll. The emboss penetration depth was 0.100 in inches and the machine speed was maintained at 200 feet per minute. The treating agent, Quasoft 202 was applied in four locations as shown in Table 4. The chemical treating agent was added at 4% based on dry weight of the sheet.

TABLE 4

| Location | Droplet Size (microns) | Basis Weight (lbs/rm) | Caliper (mils/8) | GMT (g/3 in) | Friction (GMMMD) | Modulus (g/% strain) | Retention (%) | Sensory Softness |
|---|---|---|---|---|---|---|---|---|
| Papermachine | >200 | 17.0 | 63.5 | 785 | .22 | 18.7 | 52 | 15.1 |
| Pre-Emboss Nip | >200 | 17.1 | 71.0 | 747 | .21 | 17.6 | 65 | 15.4 |
| Post Emboss Nip | >200 | 16.9 | 60.5 | 698 | .20 | 17.0 | 68 | 16.0 |
| Simultaneous Application (Pre/Post Emboss Nip) | <200 | 17.2 | 75.0 | 735 | .22 | 16.7 | 72 | 15.8 |

Examples 31–37

These examples illustrate the effect of using alternative dispersion media with the chemical treating agents of the present invention. The quaternary ammonium compounds, lotions, and amphoteric softening agents have been found to produce excellent results when they are dispersed in a medium comprising water or hydroxyl/polydroxyl solvents such as glycols. The results presented in Table 5 illustrate the effect of media used to disperse the treatment chemical before delivery to the web. In all examples, the droplet size was less than 200 microns. The treatment chemical was applied to the sheet as the sheet exited the emboss nip.

TABLE 5

| Treatment | Dispersing Medium | B. Wt (lbs/rm) | Caliper (mils/8) | GMT (g/3 in) | Friction (GMMMD) | Modulus (g/% strain) | Sensory Softness |
|---|---|---|---|---|---|---|---|
| Control | | 17.3 | 63.9 | 761 | .20 | 17.7 | 15.1 |
| Quasoft 218 | water | 17 | 64.4 | 775 | .21 | 19.5 | 16.0 |
| Varisoft 3690 | water | 17 | 62.5 | 757 | .22 | 19.3 | 16.3 |
| Varisoft 475 | water | 17 | 62.3 | 761 | .21 | 19.1 | 16.6 |
| Quasoft 218 | Propylene Glycol | 17 | 69.6 | 712 | .22 | 18.2 | 16.7 |
| Varisoft 3690 | Propylene Glycol | 18 | 68 | 766 | .21 | 17.7 | 16.8 |
| Varisoft 475 | Propylene Glycol | 18 | 69.7 | 807 | .21 | 17.7 | 16.8 |

Examples 38–42

The effects of chemical concentration are illustrated in these examples. The treatment chemicals noted in Table 6, below were found to produce excellent results at varied concentrations. Chemical treatment agents were used to treat tissue prior to entering the emboss nip. The concentrations of the treatment chemical were maintained at 4% and 8%.

The results are presented in Table 6.

TABLE 6

| Treatment | Concentration (%) | B. Wt (lbs/rm) | Caliper (mils/8) | GMT (g/3 in) | Friction (GMMMD) | Modulus (g/% strain) | Sensory Softness |
|---|---|---|---|---|---|---|---|
| Control | n/a | 17.3 | 63.9 | 798 | .22 | 17.7 | 15.1 |
| Quasoft 218 | 4% | 17.5 | 69.9 | 785 | .21 | 18.4 | 15.3 |
| Varisoft 475 | 4% | 17 | 65 | 659 | .21 | 17.2 | 15.2 |
| Quasoft 218 | 8% | 17.1 | 71 | 747 | .21 | 19.6 | 15.4 |
| Varisoft 475 | 8% | 17 | 68.4 | 647 | .21 | 17.5 | 15.7 |

Figure 4:
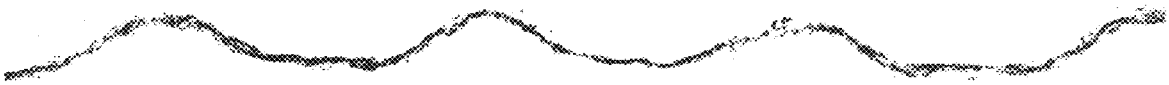
FIG. 4 is a cross-sectional micrograph of a chemi-mechanically embossed tissue product that was treated with a softner/debonder prior to the web entering the embossing nip.
Figure 5:
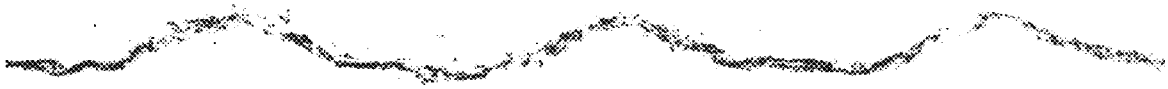
FIG. 5 is a cross-sectional micrograph of a chemi-mechanically embossed tissue product that was treated with a softener/debonder after the web entered the embossing nip.
Figure 6:
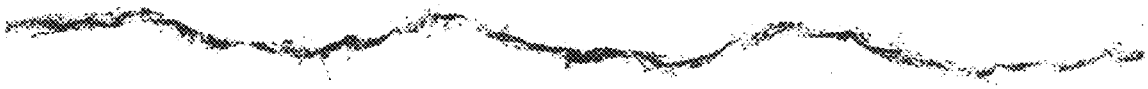
FIG. 6 is a cross-sectional micrograph that was neither pre- or post-treated with a softener/debonder.

FIGS. 4, 5 and 6 are photographs of an embossed tissue product that has been treated in accordance with the present invention. In FIG. 4, all softener compositions were applied prior to the last embossing stage of the tissue web. In FIG. 5, a softener/debonder was applied after the last embossing stage of the tissue web. In FIG. 6, a softener/debonder was applied both before and after embossing of a tissue web. From FIGS. 4–6 it is clear that pre-emboss application creates a more defined emboss pattern than either the post-emboss application or the pre-emboss and post-emboss applications. There appears to be little difference in emboss definition between the post-emboss application of FIG. 5 and the pre- and post-emboss application of FIG. 6.

Figure 7:
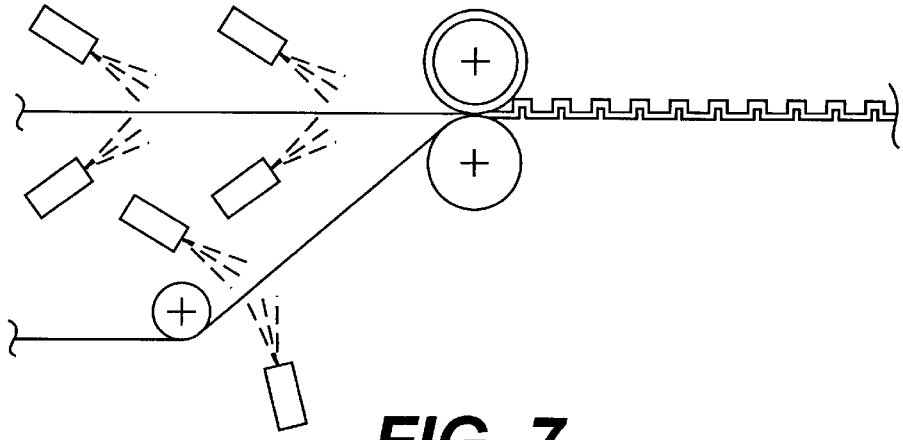
FIG. 7 illustrates a pre-emboss application configuration for applying a medium to a web.
Figure 8:
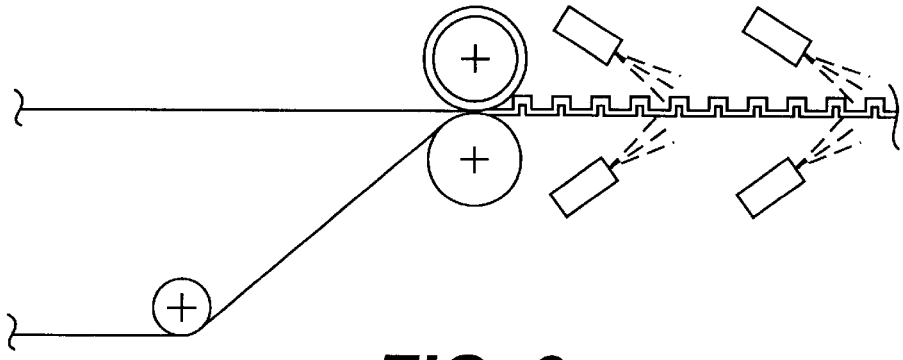
FIG. 8 illustrates a post-emboss application configuration for applying a medium to a web.
Figure 9:
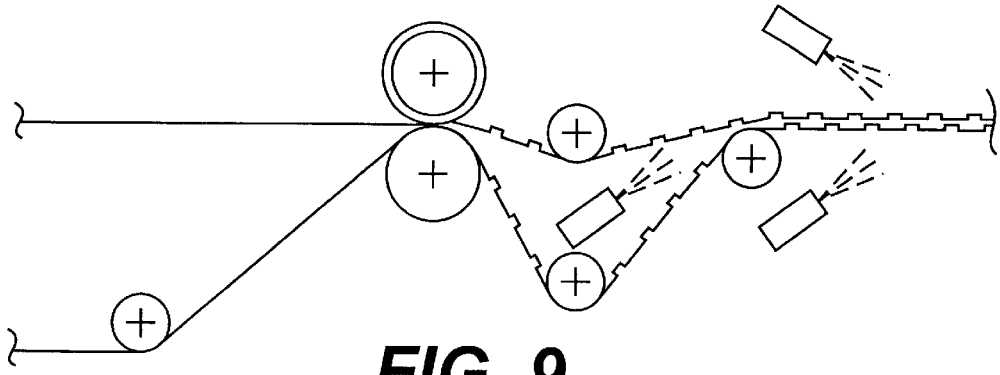
FIG. 9 illustrates a two-ply post-emboss application of a medium to each ply of the two-ply product.

FIGS. 7 and 8 are cross-section photomicrographs of embossed tissue products that were treated in accordance with the present invention. FIG. 9 is an untreated tissue control. In FIG. 7, a softener was applied prior to embossing the tissue web. In FIG. 8, a softener/debonder was applied after the last embossing state for the tissue web. FIG. 7 illustrates that pre-emboss application of a liquid creates more localized densification of the substrate on the top of the protuberance as compared to the post-emboss application or the control. This increased densification retains the definition of the emboss pattern more readily, thereby increasing emboss definition.

By way of illustration, FIGS. 10–14 illustrate a single-nip, rigid-to-resilient embossing configuration according to one embodiment of the present invention. However, as discussed above, other configurations can be used and would be well understood by the skilled artisan.

Figure 10:
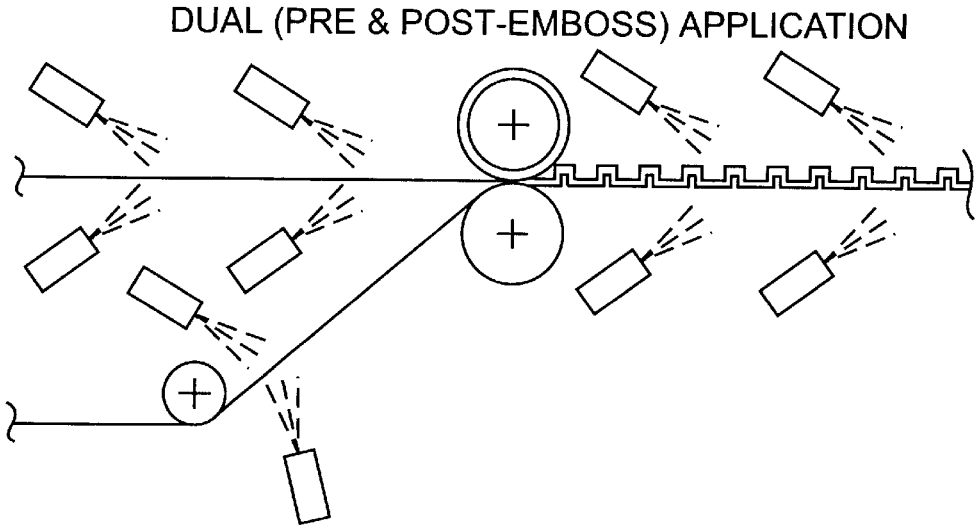
FIG. 10 illustrates a combination pre- and post-emboss application configuration for applying a medium to a web.

FIG. 10 illustrates the pre-emboss application configuration. The substrate to be embossed could be a single-ply or multi-ply substrate. One or more applicators can be located to apply the surfactant to either one or both sides of each substrate ply. Any number of applicators can be employed, each supplying the same or different surfactants and each delivering the same or varying amounts of a given surfactant. A multitude of alternate arrangements of the applicators, the number of applicators, the surfactants, and the number of substrates plies will all be readily apparent to the skilled artisan.

Figure 11:
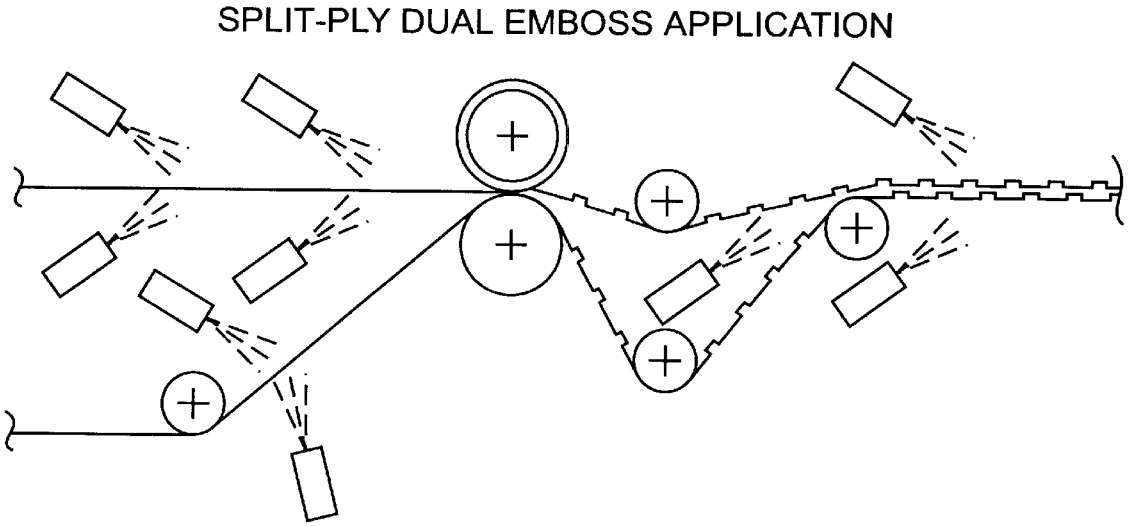
FIG. 11 illustrates a two-ply pre- and post-emboss application of a medium to each ply of the two-ply product.

FIG. 11 illustrates the post-emboss application configuration. One or more applicators can be located to apply the surfactant to either one or both sides of the embossed web. Any number of applicators can be employed each supplying the same or different surfactants and each delivering the same or varying amounts of a given surfactant. One skilled in the art could arrange the number of applicators, the surfactants and the sides of the embossed web into a multitude of combinations, all of which are within the scope of the present invention. In most cases the embossed web will be considered as a single web with two sides. However, in the special cases of split-ply embossing, illustrated in FIG. 12, and in points-to-the-inside (PTI) embossing, each pre-embossed substrate ply could have surfactant applied to it in the post-emboss configuration.

For a single or multi-ply product, the plies of the product could be treated in the pre-emboss configuration as described above and then embossed. After embossing, the pre-treated, single or multi-ply embossed web is treated again with the post-emboss application configuration, see for example FIG. 13. As noted above, a multitude of variations will be readily apparent to the skilled artisan and considered to be within the scope of the present invention. By practicing dual surfactant application with either split-ply embossing, see for example FIG. 14, or PTI embossing, each individual ply of the multi-ply produce could independently be treated in both pre-emboss and post-emboss application configurations using the same or different surfactants.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

We claim:

1. A soft absorbent paper web having been subject to chemi-mechanical embossing and exhibiting enhanced pattern definition having a solids content of not less than 75% and a pore size distribution from about 100 to about 1000 $\mu$m, said absorbent web having been treated with a liquid treating agent having an average droplet size of not greater than 200 microns.

2. The paper web of claim 1, wherein said web is a paper towel.

3. The paper web of claim 1, wherein said web is a napkin.

4. The paper web of claim 1, wherein said web is a tissue.

5. The paper web of claim 1, wherein said treating agent has an average droplet size of not greater than 100 microns.

6. The paper web of claim 1, wherein said treating agent has an average droplet size of not greater than about 75 $\mu$m.

7. The paper web of claim 1, wherein said treating agent has an average droplet size of not greater than about 50 $\mu$m.

8. The paper web of claim 1, wherein said cellulose web has a solids contents of not less than about 85%.

9. The paper web of claim 1, wherein said cellulose web has a solids content of not less than about 95%.

10. The paper web of claim 1, wherein said treating agent is chosen from at least one of cationic, anionic and nonionic softeners and debonders, humectants lotions, botanical extracts, perfumes, mineral oils, refined oils, disinfectants, water, surfactants, silicones and the like.

11. A product produced by efficiently delivering a treating agent to an absorbent cellulose web comprising:

providing an absorbent cellulose web having a solids content of at least 70% and a pore size distribution from about 100 to about 1000 $\mu$m;

treating said web with a liquid treating agent having an average droplet size not greater than 200 $\mu$m.

12. The product of claim 11, wherein said treating agent is applied prior to entry of the cellulose web to an emboss nip.

13. The product of claim 11, wherein said treating agent has an average droplet size not greater than 100 $\mu$m.

14. The product of claim 11, wherein said treating agent has an average droplet size not greater than about 75 $\mu$m.

15. The product of claim 11, wherein said treating agent has an average droplet size not greater than about 50 $\mu$m.

16. The product of claim 11, wherein said dried cellulose web has a solids contents of not less than about 85%.

17. The product of claim 11, wherein said dried cellulose web has a solids content of not less than about 95%.

18. The product of claim 11, wherein said treating agent is chosen from at least one of cationic, anionic and nonionic softeners and debonders, humectants lotions, botanical extracts, perfumes, mineral oils, refined oils, disinfectants, water, surfactants, silicones and the like.

19. The product of claim 11, wherein said treating agent is applied prior to pressing of the cellulose web between two rolls.

20. The product of claim 11, wherein said treating agent is applied prior to entry of the cellulose web to an emboss nip.

21. The product of claim 11, further comprising applying said treating agent to said cellulose after embossing of said web.

22. The product of claim 11, wherein embossing is carried out between two rigid rolls.

23. The product of claim 11, wherein embossing is carried out between a rigid roll and a resilient roll.

* * * * *

UNITED STATES PATENT AND TRADEMARK OFFICE

CERTIFICATE OF CORRECTION

PATENT NO. : 6,649,024 B2
DATED : November 18, 2003
INVENTOR(S) : T. Phillips Oriaran et al.

It is certified that error appears in the above-identified patent and that said Letters Patent is hereby corrected as shown below:

Title page,
Item [12], "Oriarian et al." should read -- Oriaran et al. --
Item [75], Inventors, "T. Philips Oriarian" should read -- T. Phillips Oriaran --.

Column 18,
Line 50, "contents" should read -- content --.

Signed and Sealed this

Thirteenth Day of April, 2004

JON W. DUDAS
*Acting Director of the United States Patent and Trademark Office*